United States Patent [19]

Godlewski

[11] Patent Number: 4,666,140

[45] Date of Patent: May 19, 1987

[54] SELF-CONTAINED SERIALLY ARRANGED PLURAL SECTION CONVEYOR

[76] Inventor: Edward S. Godlewski, 129 S. Spruce St., Wooddale, Ill. 60691

[21] Appl. No.: 755,337

[22] Filed: Jul. 16, 1985

[51] Int. Cl.[4] ..... B65H 3/04

[52] U.S. Cl. ..... 271/35; 271/117; 271/125; 271/151; 271/166; 271/171; 198/461

[58] Field of Search ..... 271/3.1, 35, 109, 37, 271/117, 150, 151, 182, 165, 166, 144, 125, 171; 414/113, 125, 129, 130; 198/461

[56] References Cited

U.S. PATENT DOCUMENTS

| | | | |
|---|---|---|---|
| 3,693,966 | 9/1972 | Bloom | 271/237 X |
| 3,900,115 | 8/1975 | Kumagai | 414/130 X |
| 3,907,278 | 9/1975 | Jaton | 271/35 X |

*Primary Examiner*—Richard A. Schacher

*Attorney, Agent, or Firm*—John J. Kowalik

[57] ABSTRACT

A self-contained conveyor is adapted to be seated or bodily removed with respect to a support of an associated press. The conveyor has a gravity feed section for receiving a pile of stock items imbricately arranged thereon and delivering the items onto a pile fragmentizing roller assembly. The roller assembly separates the piled items by transporting the items over it and feeds items onto a belt conveyor which in turn delivers the items against a fanning mechanism. The bottom item is delivered into a metering nip defined between a retard and cooperating feed roller assembly which delivers each item to a pickup station of a press beneath a sensing finger switch. As long as each item remains on the station, it prevents the finger from dropping to close the switch and actuate a circuit which operates the belt conveyor and feed roller to deliver the next bottom item to the station.

11 Claims, 17 Drawing Figures

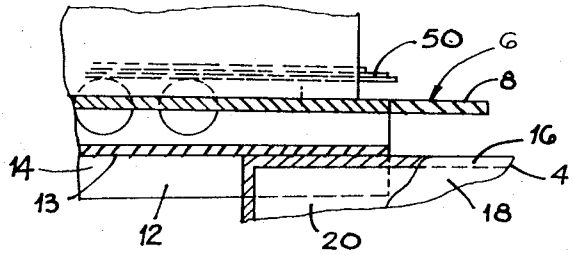
Fig. 7
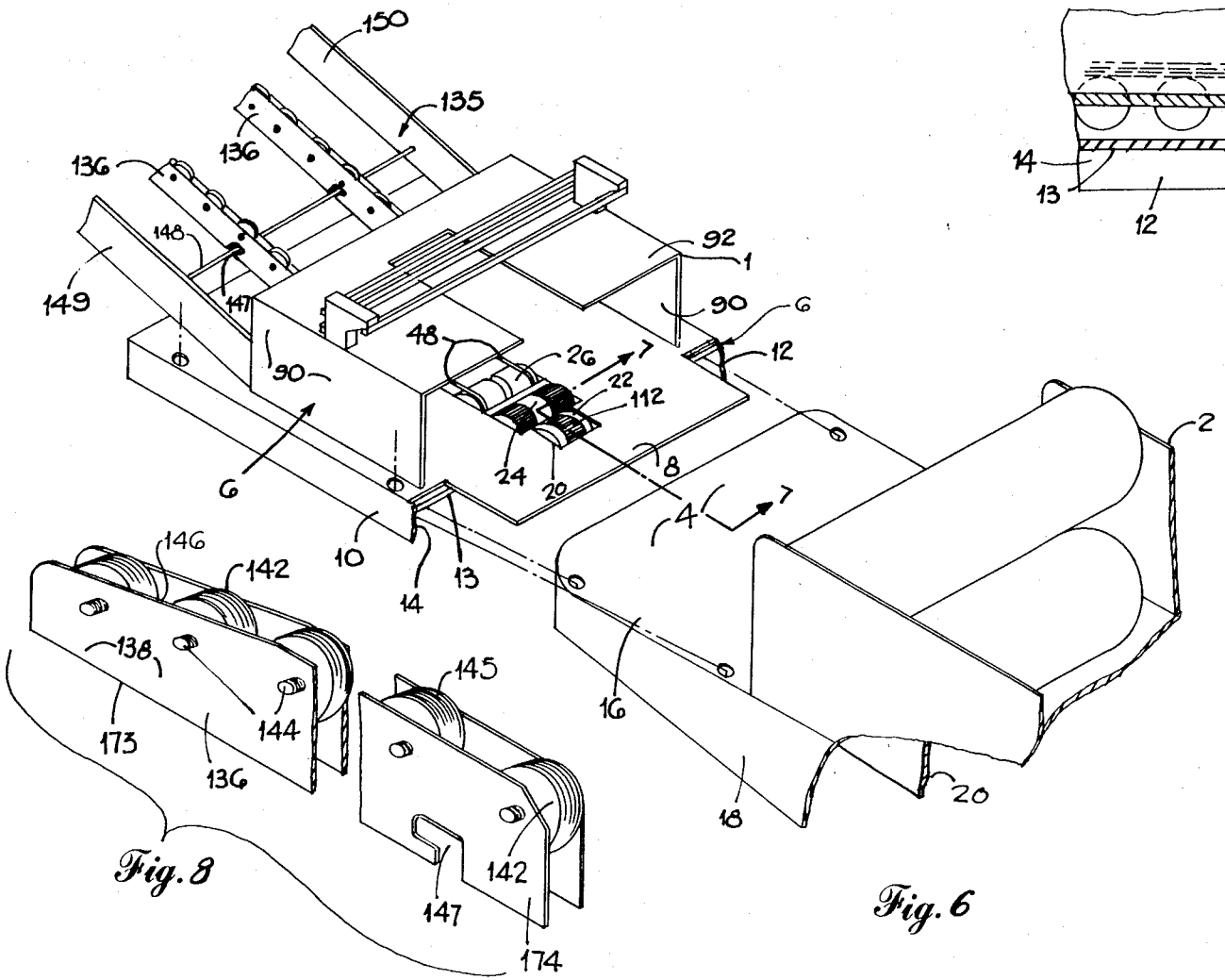
Fig. 6
Fig. 8

SELF-CONTAINED SERIALLY ARRANGED PLURAL SECTION CONVEYOR

BACKGROUND OF THE INVENTION

In the art of conveying from a pile paper stock items such as sheets of paper or envelopes or the like the use of gravity feed conveyors, to which this invention pertains, is known. Such feeders have on common deficiency in that they usually feed erratically. A high stack of items in bottom feed conveyors entails high static loads on the bottom item and it is difficult to pull out each item from the bottom without the overburden of stock items shifting toward the feeding mechanisms such as metering rollers into which the items gravitate. Unless only small piles are maintained in the stock magazine, which requires constant attendance of an operator, the feeding sequence is frustrated in that more than one item will feed through or the mechanism will jam.

SUMMARY OF THE INVENTION

This invention is directed to a gravity feed conveyor in which the stock is laid imbricately in a pile in a delivery slide of a gravity feed conveyor section which is angled downwardly toward its delivery end and in which a series of free wheeling wheels are mounted on the bottom of the guide to facilitate transposrting the items piled thereon toward its delivery end to a pile separator which also functions as a pusher for nugging each item into a receptor, the receptor functioning to separate the items into individual units for delivery to the press.

The invention further comprehends a novel plural conveying mechanism having an upper gravity feed part which discharges the items onto a free rolling annular roller which is adapted to break up the load being delivered from the gravity feed part into small piles of stock items as they cascade thereover so as to minimize the load on the lowermost item which thus can more freely separate from those thereabove and be dragged by an underposed powered belt conveyor feeding each item into a retard assemby which cooperates with an intermittently powered drive roller assembly for feeding each item in timed sequence to the press.

Another object of the invention is to provide a novel gravity feed conveyor in which the bottom is provided with a series of rollers mounted on horizontal axes on rails or supports for rolling contact with the lowermost item of a stack, the axes of the rollers in the upper portion being disposed in a common plane which is less inclined than the plane of the axes of the rollers in the lower portion of the conveyor, said planes converging upwardly intermediate the ends of the conveyor.

A further object of the invention is to provide a novel conveying system in which the roller supports are adapted to be mounted at different levels for holding the stock level which has a thicker portion at one side than the other , such as an envelope which has a flap, the thicker portion being laid over the lower support.

Another object is to provide a novel load-fractionalyzing mechanism for intercepting the bottom end of the stock at the discharge end of the gravity feed conveyor for continuously separating the stock into small increments and thus minimize loading on the lowermost item so that it is held lightly against a moving belt conveyor positioned therebeneath to which it is being delivered by the mechanism.

The invention comprehends providing novel guides for engaging the leading edges of the descending stock items on the gravity feed conveyor and arranging them shingle fashion as they proceed down the gravity feed conveyor whereby the lowermost item leads those thereabove and is thus separately presented to the metering mechanism.

A further object is to provide a novel conveyor system comprising a gravity feed conveyor section at one end, a power driven conveyor section at the other end and an intervening cylindrical stack fragmenting section comprising a cylinder over which the bottom end of the stack is transported and which functions to break up the stack into small portions and maintains the imbricate arrangement of the items in which fashion the items are continuously deposited onto the belt conveyor.

Another object is to provide a novel retard system for metering stock items being fed from a stock pile in an imbricate arrangement, said system comrising a finger sloped toward the retard assembly and engaging the leading edges of the stock items to maintaim them in said imbricate arrangement, said items moving from under the finger to a pair of floating fanning wheels which peripherally engage the imbricately arranged leading edges moving from under the finger and fanning the items so that they separate easily and allow the lowermost item to move into an intake nip defined between a retard disk and an opposing pullout roller assembly.

These and other object and advantages inherent in and encompassed by the invention will become more apparent from the specification and the drawings, wherein:

FIG. 6 is a perspective view of the press mounting ledge and conveyor to be mounted thereon;

FIG. 7 is a cross-sectional view taken substantially on line 7—7 of FIG. 6.

FIG. 8 is a perspective broken apart view of one of the gravity feed conveyor sections;

DESCRIPTION OF THE INVENTION

Figure 1:
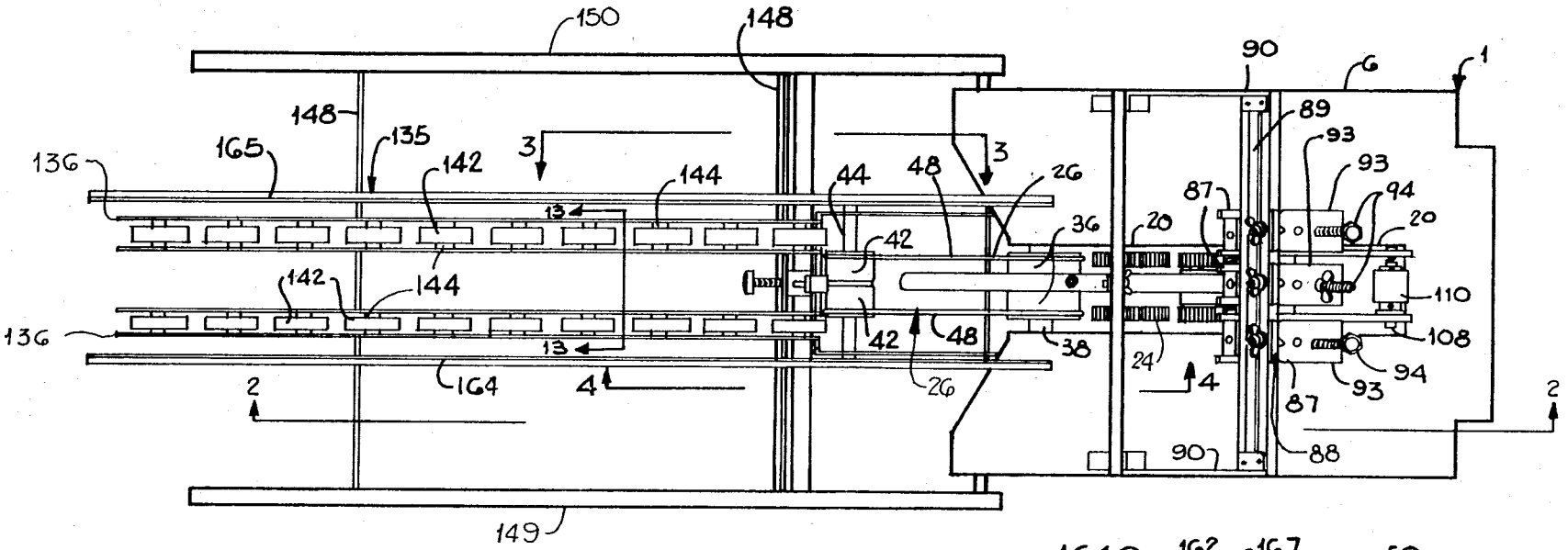
FIG. 1 is a top plan view of the novel conveyor system.

The novel conveyor system 1 is shown in association with a conventional press 2 (FIG. 6) having a vertically adjustable ledge or support table 4 to which the present invention is adapted for quick mounting and coupling and removal. The conveyor apparatus 1 comprisies a saddle or base 6 which consists of a top wall 8 and a pair of side walls 10 and 12 depending from the lateral edges of the top wall. An intermediate horizontal wall 13 is spaced below the top wall and secured to the side walls 10 and 12 and defines a pocket or channel 14 for reception of the ledge 4 for seating the intermediate wall 13 upon the top wall 16 of the ledge while the side walls 10 and 12 closely embrace the side walls 18 and 20 of the ledge. Alignment holes may be provided in the walls 8,13 and 16 for reception of quick release securing pins (not shown), if desired, although applicant has not found any need for them.

The top wall 8 is cut out to provide an elongated slot 20 through which project the upper portions of a pullout roller 22, a feed roller assembly 24 and a belt conveyor 26.

The pullout roller is mounted on and driven through a horizontal shaft 28 (FIG. 2) journaled in bearings 30 mounted in side walls 10 and 12. The feed roller assembly 24 is driven through a horizontal shaft 32 journaled in bearings 34 mounted in the side walls 10,12. Laterally spaced drive belt pulleys 36,36 are connected to a drive shaft 38 which is journaled in bearings 40 mounted in the side walls 10 and 12.

The belt conveyor 26 has a rear pulley assembly 42,42 carried on a shaft 44 which is journaled in the rear end of a frame 46 extending between shafts 44 and 38 and journaled at its forward end by bearings 47 (FIG. 2) on the shaft 38 for vertical pivotal movement thereabout at its rear end for adjusting the vertical slope position of a pair of belts 48,48 laterally spaced and trained about the pulleys 36,36 and 42,42 to an optimum position for receiving the particular stock 50 being deposited thereupon. A vertically adjustable link or rod 52 (FIGS. 2 and 4) is pivoted at its upper end as at 54 to the frame 46 intermediate the ends thereof, and the link extends through and is adjustably secured to a suitable securing clamp 55 which is pivotally connected to pivot on a horizontal axis to a support bar 56 mounted on the side walls 10 and 12 of the base frame. Clamp 55 is releasably secured to bar 56 by a thumb screw 55' after adjustment of the height of the rear end of the belt conveyor is accomplished. A generally horizontal side rail or bar 58 is provided along each side of the belt conveyor, and a bracket 60, which has a bottom opening slot **60*a* is releasably mounted on each rail 58 and is clamped thereto by a thumb screw for adjustment fore and aft along the length of the rail which at its front end is pivotally mounted on a horizontal axis at 62 to a portion of a side wall 10 or 12 thereadjacent (FIGS. 3 and 4) for vertical pivotal movement thereabout. The rear ends of the side bars 58 are interconnected by a transverse rod 64 which is pivotally secured intermediate its ends to the upper end of and adjusting rod 65 (FIGS. 3 and 4), the rod 65 being secured releasble to a clamp 66 which is pivotally mounted on a horizontal rod 68 carried by a bracket 69** secured to a portion of the base frame.

Figure 11:
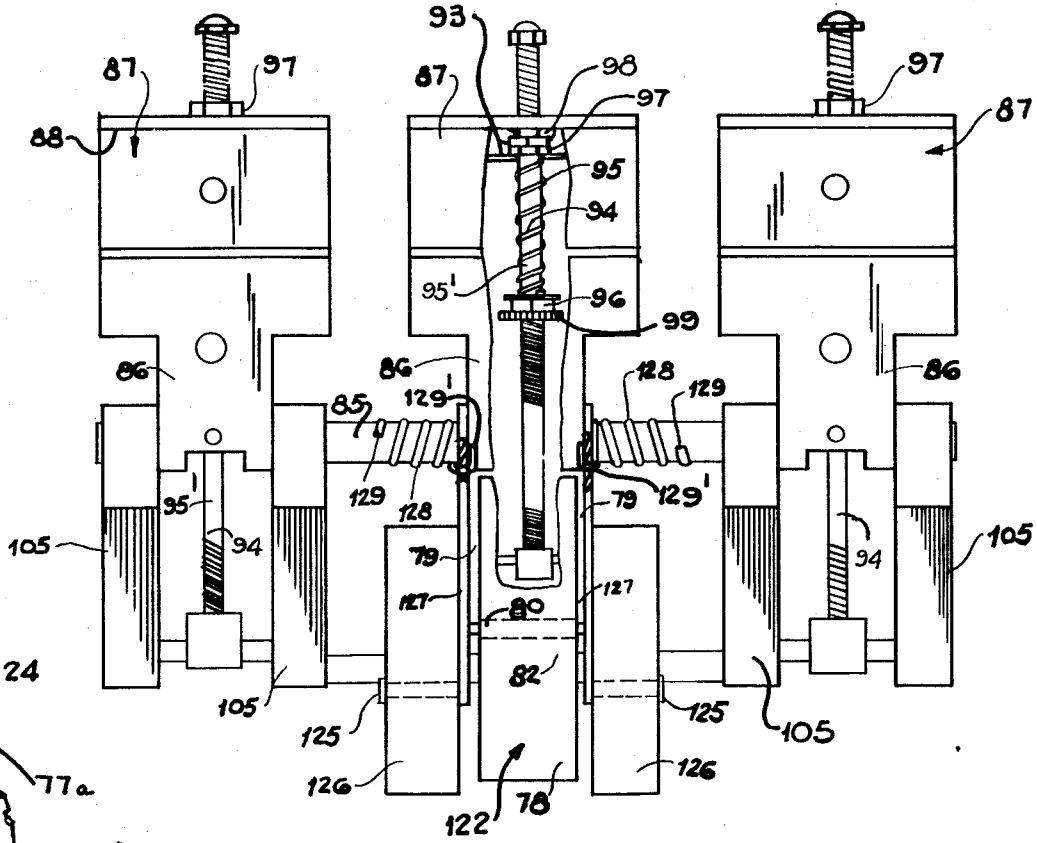
FIG. 11 is a leading end view of the retard assembly partly broken away.

A load-fragmenting or separator pusher device 70, comprising a wheel or cylinder is rotatably mounted on a pin 72 on a horizontal axis to the upper end of each bracket 60, which at its lower end is provided with a bar-receiving jaw **72*a* (FIG. 5) which has the locking thumb screw 73 adapted to engage and tighten against the related mounting bar 58. Thus the load-fragmenting device, which is herein shown as comprising two free rotating disks 71 is adjustable lengthwise of the belt conveyor toward and away with respect to the retard or receptor nip 75 developed between the smooth-faced center roller wheel or disk 77 of the pullout assembly 24 and a nonrotating retard disk 78 (FIGS. 2 and 11) positioned thereabove. The retard disk or wheel is made of elastomeric-like material and is carried by a pair of arms 79,79, which are secured at their lower ends by a releasable locking bolt and nut assembly 80 clamping the disk 78 between the arms 79 but permiting incremental adjustment periodically thereabout as the disk 78 wears. The retard disk has a smooth perimeter 82 and is adapted to engage the leading ends 83 of several of the imbricately arranged stock items being presented thereto. The arms 79 are pivotally mounted at their other ends on a horizontal rod 85 (FIGS. 7 and 11) which extends through the lower ends of depending lugs 86 (FIG. 3) of three identical brackets 87, each of which is secured at its upper end by a clamp 88 (FIGS. 1 and 2) to mounting bars 89 spaced above the conveyor and secured at their ends on the side panels 90,90 of a cover 92 which is secured to the base 6**.

Each bracket has an upper leg 93 which extends forwardly through which an adjusting biasing assembly screw 94 extends. A spring 95 is sleeved on the shank 95' of the screw or bolt 94 and is compressed between the lower side of the leg 93 of the associated bracket and a compression adjusting nut 96 threaded on the shank 95'. A limit nut 97 is threaded on the shank 95' and seats against the top of leg 93 and is locked by a wing nut 98 threaded on the shank 95' above the nut 97. A locking nut 99 is threaded on the shank 95' and after proper determined adjustment of the compression of the spring, nut 99 is tightned against nut 96.

The retard is adjusted by manipulating the nuts on its bolt 94 to provide a nip 75 having a spacing from the roller therebelow slightly less than the thickness of the items 50 being fed thereinto. The nip is defined with the lower feed roll assembly 24.

The side brackets 87,87 each support an adjusting screw assembly essentially identical with the screw 94 of the center bracket 87 and all parts therefore will be identified with the same reference numerals, and each of these assemblies 94 biases an arm 105 mounted pivotally at its upper end on the rod 85. Each arm 105 is offset inwardly at its lower end and at said end has an elongated slot 106 through which extends a nut and bolt assembly 108 rotatably mounting a free rolling upper pullout roller 110 which opposes the lower driven pullout roller 22. The adjusting nut 96 of each side bracket assembly 94 is rotated on the shank 95' to compress the spring 95 to achieve the desired bias and then the limit nut 97 is threaded down to limit the downward movement of the top pullout roller 110 sufficient to grasp the delivered item with the roller 22.

Figure 10:
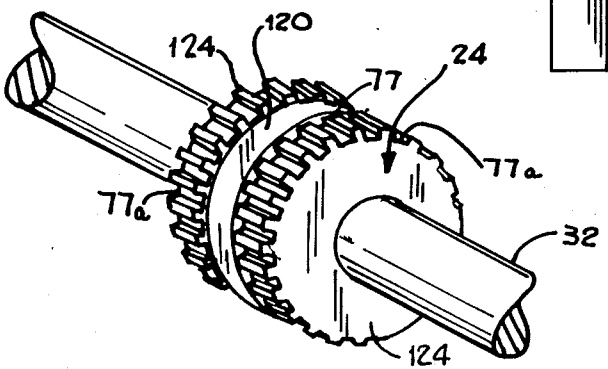
FIG. 10 is an enlarged perspective view of the pullout roller assembly.
Figure 15:
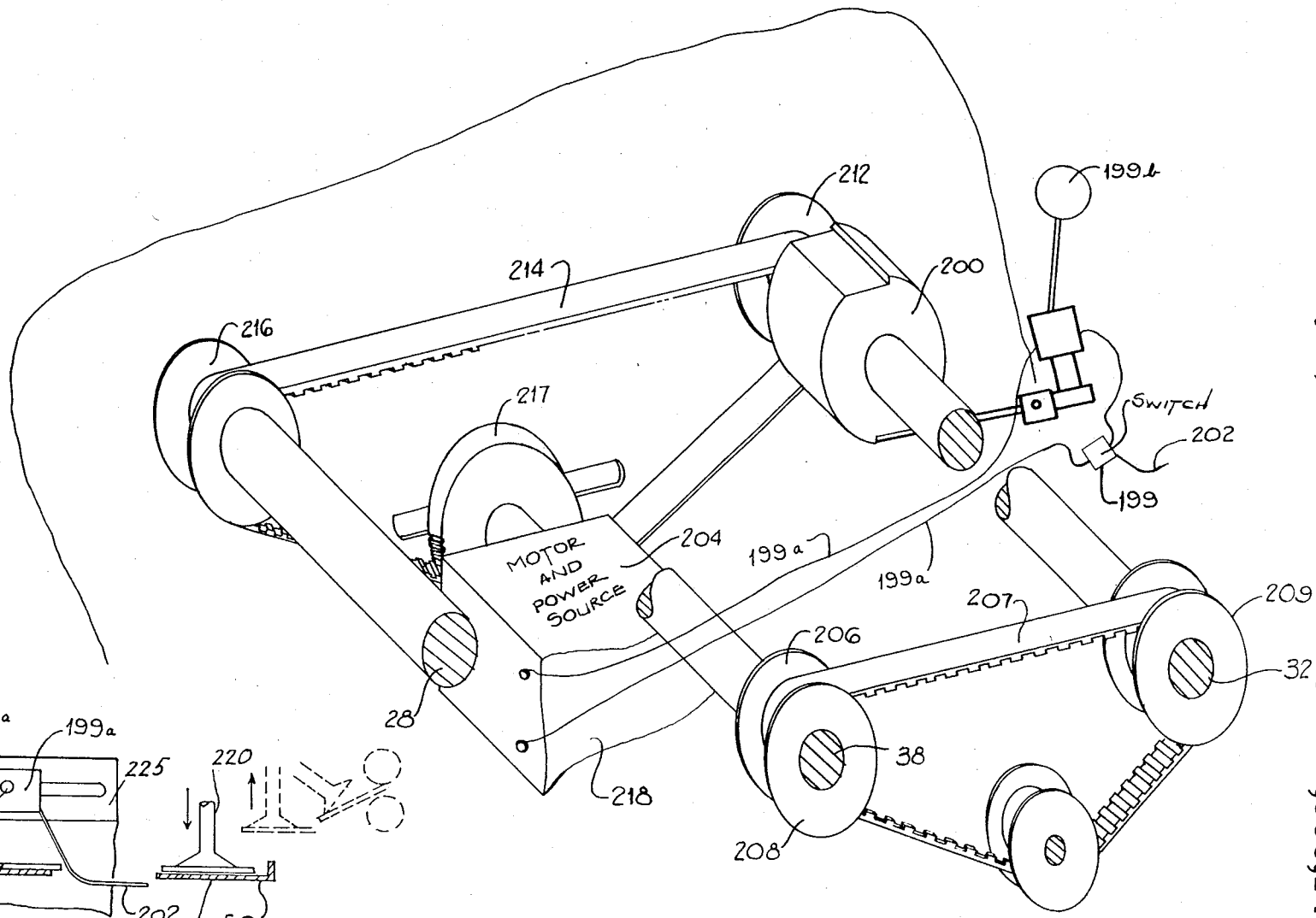
FIG. 15 shows a drive arrangement in perspective of the belt conveyor and pullout roller assembly.
Figure 16:
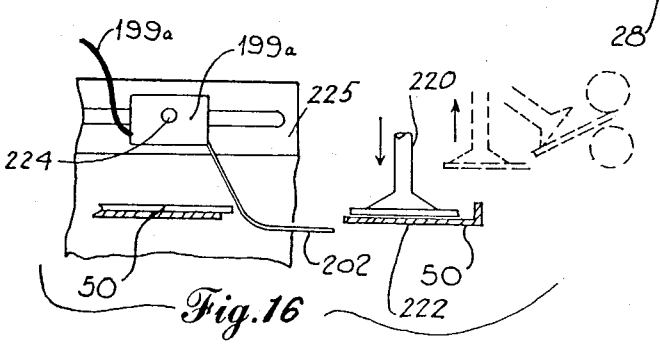
FIG. 16 is a side elevational view partly diagramatic of the feed control and press relation.

The feed roller assembly 24 comprises in addition to the center disk 77 with its smooth face 120 (FIG. 10), which opposes the smooth face 122 (FIG. 2) of the retard disk 78 and a pair of serrated rollers or disks 124,124 with flexible transverse peripheral ribs. Rollers 124 and their ribs are also made of flexible elastomeric material such as butane or a flexible resin such as polyethylene or polypropylene or the like.

The disks 124, 124 oppose free rolling nylon feathering or fanning disks 126,126 (FIGS. 2 and 11) each of which is journaled at 125 on the lower free end of a carrying arm 127 which at its other end pivots on the rod 85. The arms 127 and thus the disks 126 are biased downwardly by torsion springs 128 which are sleeved on the rod 85 and one end 129 is connected to the rod 85 and the other end is hooked as at 129' to the respective arm 127. Thus as the stock is moved forward toward the wheels 126 and drops, the wheels 126 engage the leading edges 83 of the stock and rotate in the direction of the arrow (FIG. 2) maintaining the items in the imbricated relation and feeding them downwardly into the nip 75. The frictional resistance developed by the wheels rubbing against the edges 83 causes the items engaged by the wheels 126 to separate or fan and separately enter sequentially from the lowermost item into the nip 75.

Figure 2:
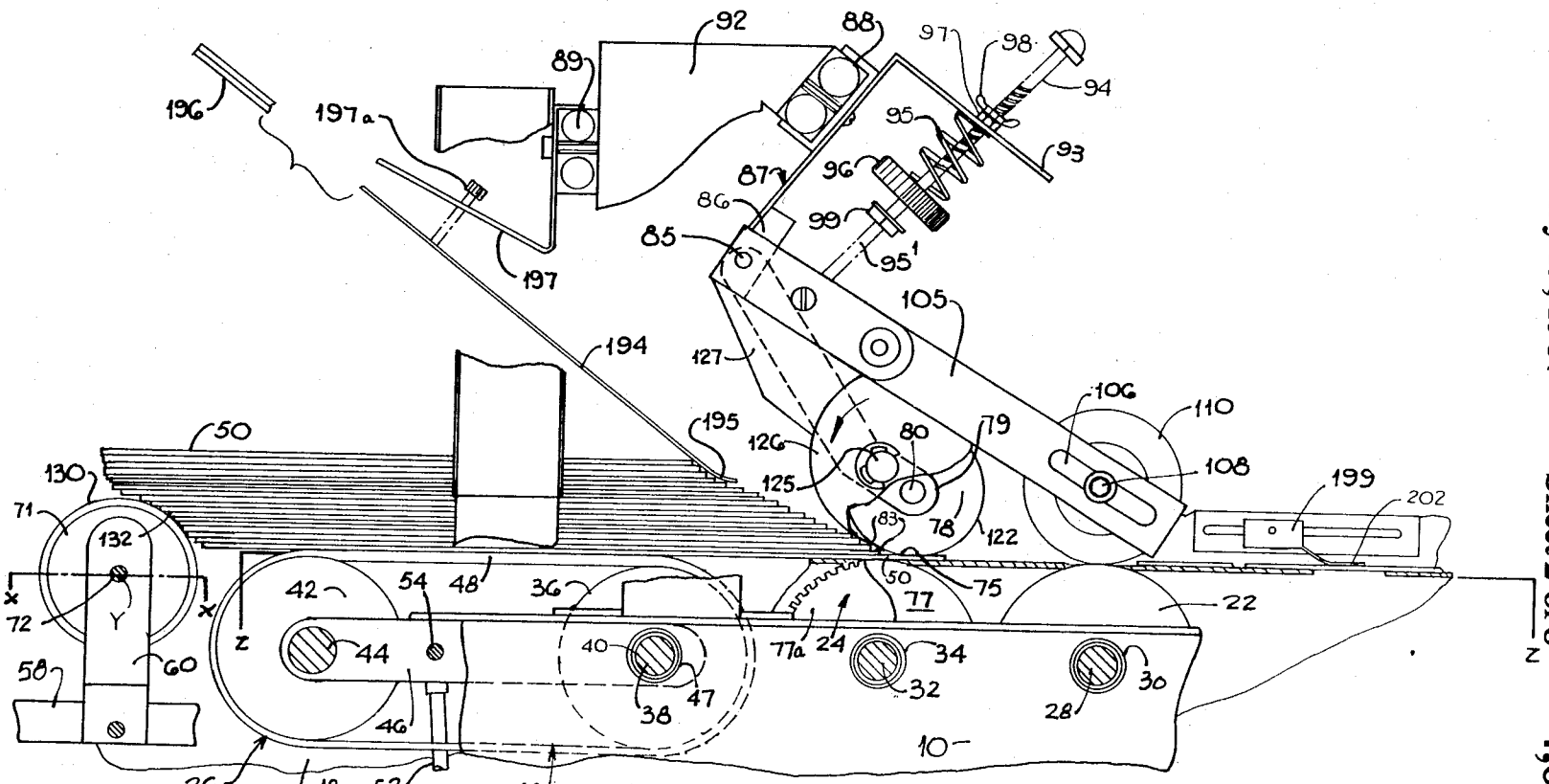
FIG. 2 is a fragmentary enlarged side elevational view partly in section taken substantially on line 2—2 of FIG. 1.

As best seen in FIG. 2 the load fractioning wheel assemblies have their peripheries 130 engaging the trailing ends 132 of the items as they move off the wheels 71 onto the conveyor belts and serve to push these items forwardly toward the retard. It will be seen that the lowermost item is always laid upon the belts 48 as it enters the nip 75.

It will be understood that the axes y of the two load-fragmenting wheels 71 provided by the pins 72 are preferably positioned beneath the plane of the belt conveyors so that the horizontal diametrical plane of each wheel 71 as indicated by the line x—x (FIG. 2) is below the plane z—z of the belts and thus the wheels 71 are caused to wedge and push or nudge each item 50 toward the retard nip 75 as the trailing end of that item descends along the forward upper quadrants of each wheel 71 opposing the nip. It will now be apparent that this feature also aids in separating the items on the belt conveyor so that they feed into the nip one at a time.

Figure 13:
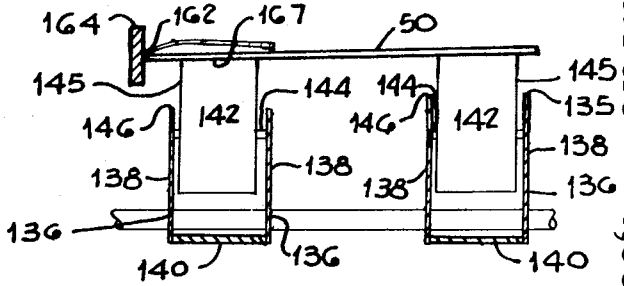
FIG. 13 is an enlarged cross-sectional view taken substantially on line 13—13 of FIG. 1.

A gravity feed conveyor generally designated 135 feeds the stock items over the load fractionating wheels 71 and comprises a plurality of side by side positioned racks each of which consists of a beam or channel 136 for lateral adjustment and each having a pair of upright flanges 138,138 (FIG. 13) and an interconnecting bottom web 140. A plurality of wheels 142 are rotatably mounted on the pins or rivets 144,144 from the side flanges 138,138 and each wheel 142 has a sector 145 projecting above the upper edges 146,146 of the side flanges and provides a rolling support for the stock items positioned thereupon. Each beam is notched at 147,147 on its bottom side and provide entry for transverse support rods 148,148 which extend between and are connected with the side frame panels 149,150 (FIG. 6) of the gravity feed conveyor and which defines a delivery chute for the stock items 50.

The side panels 149,150 have forwardly open slots 151 at their forward lower ends which admit a transverse support rod or bar 152 mounted on the side panels or frame structure of the base 6. Thus the gravity feed conveyor section is adapted to swing vertically about the rod 152 and thumb screws 153 are provided to secure the conveyor 135 to the rod 152.

The conveyor 135 is secured in selected vertically adjusted position by a cam 154 (FIGS. 3 and 17) which is rotatable about a horizontal axis with a shaft **154*a* journaled through a bracket 159 mounted on the frame walls 10 and 12 of the base 6. The shaft 154*a* is rotated by a handle 155. The cam profiles engage the lower edges of the frame members 149, 150 of the conveyor 135. It will be undertood that there are two cams 154 disposed adjacent each end of the shaft 154*a*, one of the cams being under member 149 and the other under member 150 in engagement with the lower edges thereof. The cams 154*a* may be secured in adjusted position after angling the conveyor section 135 as required, by a set screw 158 threaded through a bracket 159 provided on the frame member 149**.

Figures 3, 5, 17:
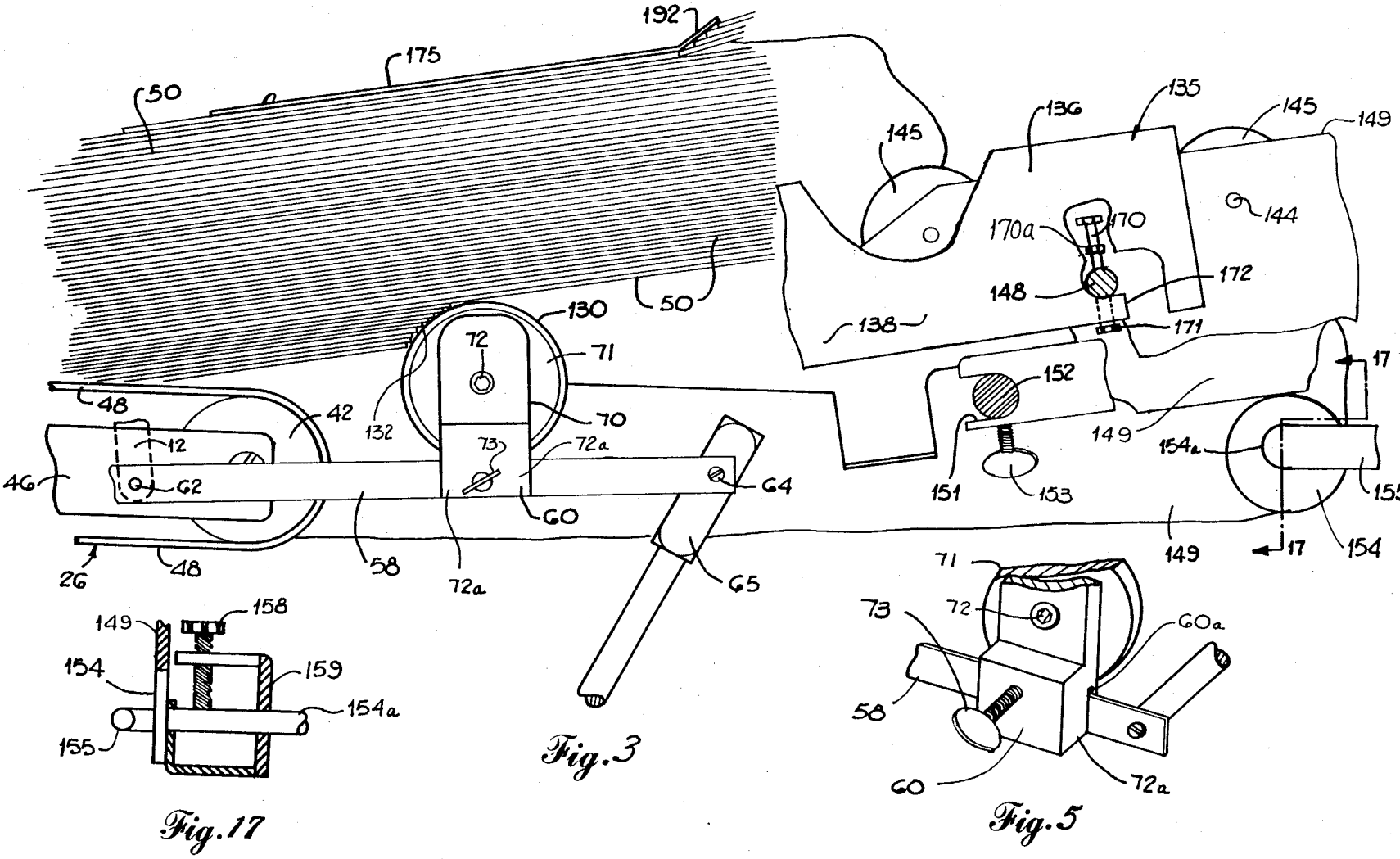
FIG. 3 is a further enlarged side elevational view partly in section taken substantially on line 3—3 of FIG. 1 with parts broken away.
FIG. 5 is a perspective view of a fractionalizing wheel.
FIG. 17 is a sectional view taken substantially on line 17—17 of FIG. 3.
Figure 4:
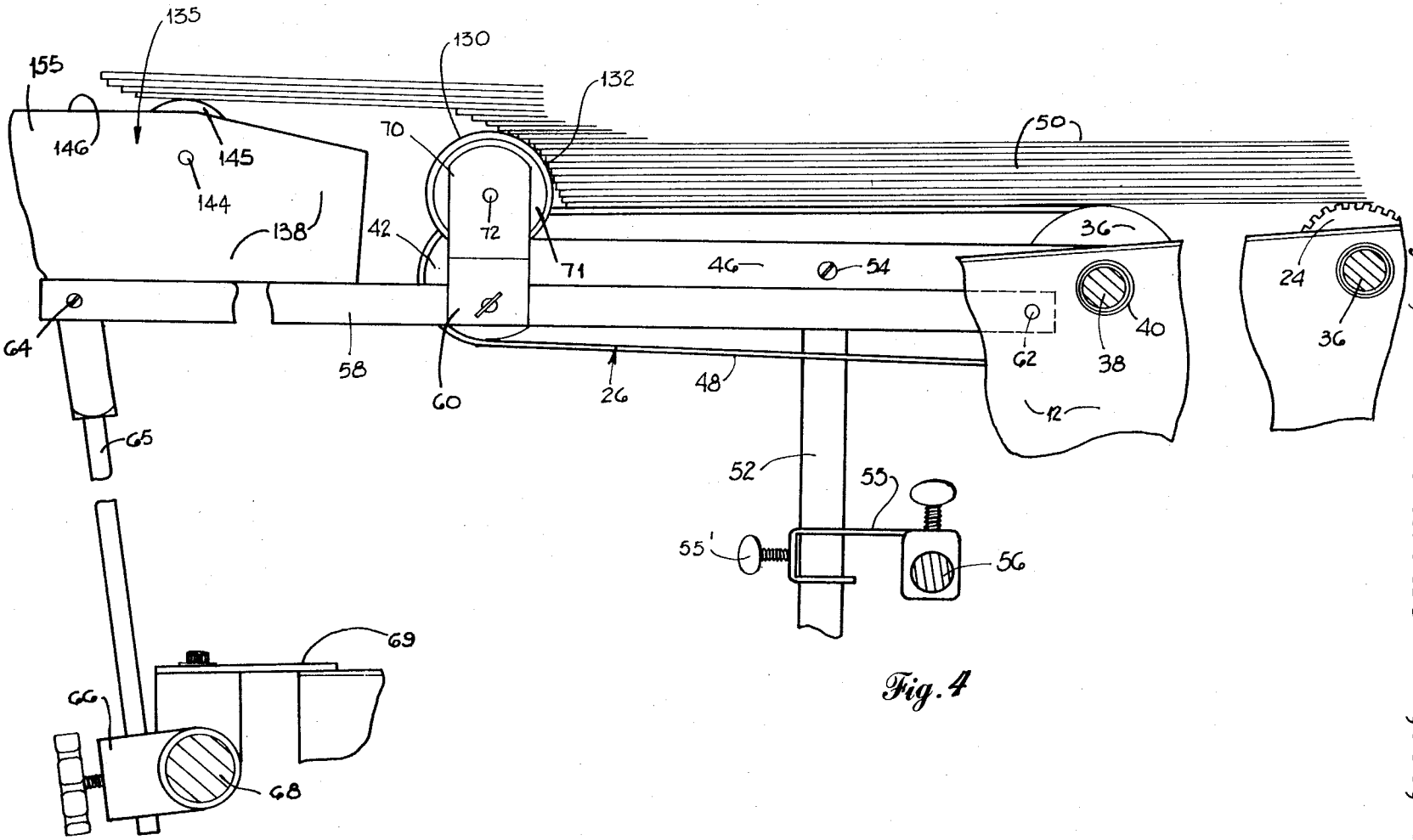
FIG. 4 is a longitudinal sectional view taken substantially on line 4—4 of FIG. 1.

The wheel-carrying beams or portions 136 of the gravity feed conveyor are each laterally as well as vertically adjustable individually as seen in FIG. 3, for best feed of different stock materials. When feeding items 50 such as envelopes it is preferable that the longitudinal edge 162 (FIG. 13) of the envelope bear along the interior of the side guide 164, which is laterally movably mounted on the rods 148 and opposes a similarly mounted opposing longitudinal guide 165. Guides 164, 165 flank the bar assemblies 136,136 and are supported on the rods 148. It will be noted that the flaps 167 on the envelopes along their edges 162 cumulatively increase the height of the stack along guide 164. The beams 136 are adjustable vertically with reference to the support bars 148. In the drawings the beam 136 remote from guide 164 is positioned vertically higher than the beam alongside guide 164,thus compensating for the increased flap height. The adjustment may comprise an adjusting screw 170 (FIG. 3) threaded in a bracket **170*a* positioned above the support bar 148 and secured by an opposing set screw 171 being threaded through a lip portion 172 of the respective channel and bearing against the underside of the respective rod 148. Threading and unthreading of the screws 170, 171 appropriately will raise or lower the respective channel 136**.

A feature of the invention is the provision of a dual incline in the gravity feed conveyor 135. The incline of the upper end portion 173 of the conveyor 135 is preferably about five or ten degrees less to the horizontal that the incline of the lower portion 74 (FIG. 8). Thus the included angle between the upper and lower portions is between 170° and 175°.

Figure 9:
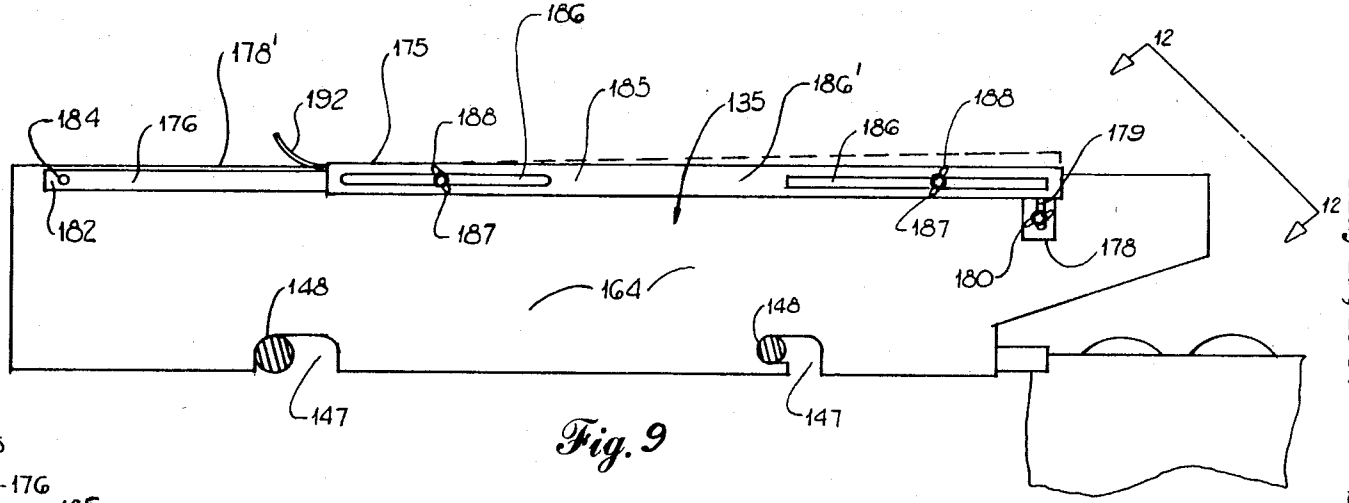
FIG. 9 is a side elevational view of a part of the gravity feed conveyor.
Figure 14:
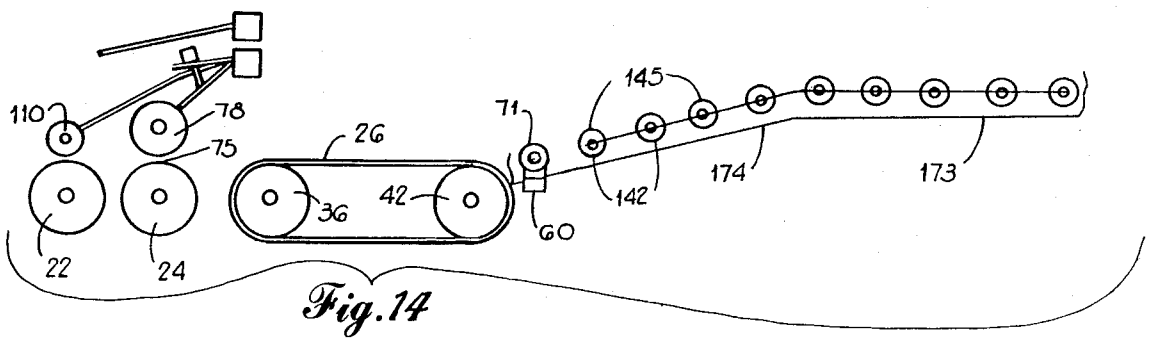
FIG. 14 is a diagramatic view of the novel conveyor system.
Figure 12:
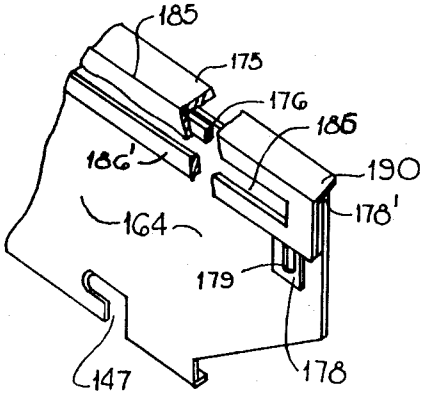
FIG. 12 is a further enlarged fragmentary perspective view of a portion of the gravity feed conveyor taken substanttially on line 12—12 of FIG. 9.

The stock items are imbricately arranged when stacked on the upper and lower portions of the gravity feed conveyor section 135. To maintain the shingle fashion arrangement a guide 175 is mounted on the side guide 164 and comprises a longitudinal support bar 176 laid against the external side of the vertical panel 164 adjacent to its upper edge 178'. The bar 176 has a depending lug 178 adjacent the delivery end of the conveyor 135 with a vertical slot 179 through which there extends a locking nut and bolt asembly 180 mounted on the panel 164. The rear or trailing end 182 of the bar is pivoted at 184 on a horizontal axis by a nut and bolt assembly secured to the panel 164. The guide has a vertical side flange 186' with a pair of longitudinal slots 186 through which extend securing members 187 carried by the bar 176 and are releasably fastened by wing nuts 188 to bar 176 as seen in FIG. 9 for adjustment longitudinally with respect to the conveyor 135. The guide 175 has an integral top flange 190 which extends laterally fron the top edge of the side flange 186 and projects therebeyond in overlapping relation to the items 50 inserted therebeneath by the operator. The top flange 190 has its inlet end curled upwardly to form a guide lip 192 guiding the lead-ends of the items stacked higher that the depth of the space between flange 190 and the rollers 142 therebeneath and functioning to imbricately arrange the items 50 passing therebeneath (FIGS. 3 and 9).

It will be realized that since the conveyor sections 173 are less inclined that the sections 174, the loading of the items toward the discharge end of the conveyor section 135 is not a single straight linear function but is divided between two force vectors. As the items are discharged off the gravity feed conveyor they straddle the load-fractionating wheels. The trailing portions of the articles 50 which straddle the wheels are carried by the conveyor section 135 and the leading ends overhang the intake ends of the belt conveyor with the bottom item 50 being being seated upon the belt conveyor as seen in FIGS. 2 and 3 and is moved with several items the above toward the retard until the trailing end of the lowermost item is carried over the top of the wheels 71 to in front thereof whereupon the leading end 83 of the lowermost item 50 is entered into the nip 75 and the next items thereabove are arranged shingle fashion with their leading ends engaging the feathering wheels 126,126 of the retard assembly. The shingling arrangement above the wheels 126 is maintained by a flexible finger 194 which has a free end 195 engaging the leading ends of the items 50 before they enter under the feathering wheels. The finger 194 is connected at its upper end 196 to a support arm 197 mounted on the support bars 89. A tension adjusting screw 197*a* is threaded through arm 197 and bears against the finger 194. Threading and unthreading of the screw 197*a* determines the amount of pressure imposed by the finger 194 against the leading edges of the articles or items 50 engaged thereby.

The pullout roller assembly and the belt conveyor are actuated by a switch 199 carried by a forward extension of the base frame 6. The switch is connected in a closed circuit through a power source with the operating solenoid 199*b* by wires 199*a* to actuate a clutch 200 which is mounted on the shaft 32 of the feed wheel assembly 24 which turns a half revolution as soon as each item moves past the trigger finger 202 of the switch 199, which causes the finger to drop sensing the absence of an item therebeneath as hereinafter further described.

The drive for the three shafts 28,32 and 38 is initiated from a constantly running electric motor 204 which has a shaft driving a sprocket or pulley 206 which drives a chain or belt 207 trained about sprockets or pulleys 208, 209. Sprocket or pulley 208 is drivingly connectible through the clutch 200 to shaft 32 for driving it one half revolution as hereinbefore stated. Shaft 32 is connected to a pulley 212 which drives a belt 214 which drives a pulley 216 connected to shaft 28. Belt 214 is wrapped about a tensioning pulley 217.

Each time the triggering finger 202 drops because its supporting item 50 is withdrawn by the pick-up mechanism of the press, the switch 199 is closed and the circuit is closed through a suitable power source 218 to the clutch causing the feed roller assembly 24 to rotate one half turn to discharge the item in the nip 75 to the pullout rollers 110, 22 which rotate continuously and to move the belt conveyor 26 appropriately to the advance the next item 50 on the belts 48, 48 to the nip 75 wherat the next item is gripped preparatory to its advance to the pullout rollers 22, 110 at the next impulse of the switch.

The items are discharged from the pullout rollers 22 to a conventional pickup mechanism of the press above the station 222. As long as the switch arm is sensing the presence of the supporting item therebeneath, the belts conveyor and the feed roller assembly 24 are inactive. However, as soon as the particular items which is beneath the switch and on the station 222 is lifted the trigger finger drops, the clutch is activated and the next item is advanced to station 222.

It is apparent that the novel conveyor hereinbefore described is entirely independent of the press and may be easily mounted and removed with respect thereto.

The swith is adjustable lenthwise of the path of travel of the feeding items by being bolted at 224 to a track 225 which is an extension of the frame 6. To speed up delivery the switch is moved closed to the pullout rollers 110,22 and to slow down the speed of the feed the switch is moved closer to station 222 or in other words away from the pullout rollers 22, 110.

Thus a novel self-contained conveyor has been disclosed in its best mode, however, it will be apparent that various modifications will now be visualized within the scope of the appended claims.

I claim:

1. In a bottom feed conveyor assembly, a first diagonally positioned gravity-feed section having an upper loading end and a lower discharge end for supporting a large pile of imbricately arranged stock items from said upper loading end to the lower discharge end, means at said discharge end for continuously fragmentizing said large pile of items descending thereupon into small imbricately arranged pile increments for obtaining low loading on the bottom item and easy removal thereof from the items positioned thereabove, a second conveyor section disposed in receiving relation to said fragmentizing means for loading with a small pile, means for removing the lightly loaded bottom item from said small pile attendant to said second conveyor section moving said small pile to a discharge position, and said fragmentizing means comprising roller means rotatable on a generally horizontal axis adjacent to the discharge end of said first conveyor section in bridging relation to said second conveyor section for carrying the stock items thereover from the first section to the second, and said second conveyor section having a delivery end, metering means at said delivery end of said second conveyor section for feeding said items one by one to associated mechanism, said metering means comprising a retard and a pullout roller assembly providing an intake nip, and means for adjustably mounting said roller means for positioning the same a distance from said nip slightly less than the length of the item being delivered thereto to the periphery of the roller means for the roller means to exert a pushing force on such item as it is being entered into the nip.

2. In a bottom feed conveyor assembly, a first diagonally positioned gravity feed section having an upper loading end and a lower discharge end for supporting a large pile of imbricately arranged stock items from said upper loading end to the lower discharge end, means at said discharge end for continuously fragmentizing said large pile of items descending thereupon into small imbricately arranged pile increments for obtaining low loading on the bottom item and easy removal thereof from the items positioned thereabove, a second conveyor section disposed in receiving relation to said fragmentizing means for loading with a small pile, means for removing the lightly loaded bottom item from said small pile attendant to said second conveyor section moving said small pile to discharge position, and said first conveyor section having a pair of side by side positioned frames with stock-supporting wheels thereon, means for positioning said frames at different elevations with respect to each other for laterally shifting the stock thereon in the direction of the lower mounted frame, and a guide disposed alongside the lower mounted frame for engagement with the adjacent edge of said stock.

3. The invention according to claim 2 and said guide comprising one of a pair of side guide means at opposite sides of said gravity feed conveyor adapted to engage the lateral edge of the items passing therealong, and top guide means mounted on one of said side guide means and having means for engaging said items at their leading edges and shifting them into an imbricate arrangement.

4. The invention according to claim 3 and said top guide means having one end pivotally mounted adjacent to the loading end of the gravity feed conveyor and having a vertically adjustable mounting at its other end adjacent to the delivery end of said gravity feed conveyor.

5. In a conveyor for separating individual items from the bottom of an imbricately layered stack, a gravity feed conveyor for supporting said stack and having an upper receiving end and a lower delivery end, said conveyor comprising an upper section and a lower section connected to the upper section and each having stack conveying means, said upper and lower sections converging upwardly intermediate the ends of the gravity feed conveyor, and said gravity feed conveyor comprising at least a pair of side by side portions, and means for mounting at least one of said portions for vertical adjustment relative to the other.

6. In a conveyor of the type described, means for conveying endwise a stack of items arranged imbricately and each having a leading and a trailing end, stack fragmentizing means at the delivery end of said stack comprising at least one element mounted for rotation on an axis transverse to the path of movement of said items and having a cylindrical periphery in intercepting relation to the items being discharged from said conveying means for separating small increments from the stack and serially carrying said increments thereover from one end of the stack to the other, second conveying means supported in receiving relation to said fragmentizing means and comprising a conveying surface moving away from and serially supporting said increments at their leading ends and dragging the same over said element a distance sufficient to engage the trailing ends of said items with said periphery, said second conveying means having a discharge end, and metering means supported at said discahrge end comprising fanning wheel means positioned to peripherally engage the leading ends of the items being delivered thereto for fanning said items apart at their leading ends for promoting entry of the leading individual item into said metering means while the trailing ends of the items engaged by the fanning wheel means are engaged by the periphery of said element and urged thereby against said fanning wheel means.

7. A conveying system for items disposed in a prearranged stock pile, said items having leading and trailing ends, said system comprising a stock-pile conveying section, a pile separating section and an individual item delivery section serially arranged for delivery of stock items from one section to another, said pile separating section and individual item delivery section comprising respectively, pusher means and receptor means spaced apart in the delivery direction of the items a distance slightly less than the span of the item delivered to a position therebetween whereby the pusher means is caused to push against the trailing end of said item to urge its leading end into said receptor means, and said receptor means comprising a retard having a cylindrical periphery and an opposing pullout roller defining an intake nip for drawing individual items therebetween and metering said items individually, and fanning wheels mounted in advance of said retard for engaging and maintaining the leading ends of said items in an imbricate arrangement and separating the items engaged thereby.

8. A conveying system for items disposed in a prearranged stock pile, said items having leading and trailing ends, said system comprising a stock-pile conveying section, a pile separating section and an individual item delivery section serially arranged for delivery of the stock items from one section to another, said pile separating section and individual delivery section comprising respectively pusher means and receptor means spaced apart in the delivery direction of the items a distance slightly less than the span of the item delivered to a position therebetween whereby the pusher means is caused to push against the trailing end of said item to urge its leading end into said receptor means, and operating means having a station downstream of said receptor means for triggering said receptor means for discharging an individual item being presented thereto to associated feed mechanism attendant to said operating means sensing the absence of an item at said station.

9. A quick-attach and detach conveyor for a press comprising a station with an item pick-up means for feeding the press and having a mounting support, said conveyor having saddle means adapted to mount the conveyor on said support, said conveyor having components dissociated from the press for moving stock items from a pile to said pick-up means, operating means on the conveyor for activating said components to a delivery mode attendant to said operating means sensing the absence of an item at said station for pickup by said pick-up means, said operating means being disposable in an inoperative mode attendant to sensing the presence of an item in pick up position, said conveyor being entirely self contained and adapted for removal from the press and mounting thereon without connection or disconnection of any components thereof with respect to the press.

10. The invention according to claim 9 and said conveyor having a cantilever mounting on said support and being attachable and detachable with respect to the press solely by manipulation of the conveyor on and off the support.

11. The invention according to claim 9 and said conveyor having a horizontal portion alignable with the press support, and having a diagonally extending loading portion projecting from said horizontal portion to provide an arm grasp thereon.

* * * * *